US009962815B2

(12) United States Patent
Zhang

(10) Patent No.: US 9,962,815 B2
(45) Date of Patent: May 8, 2018

(54) DRIVER TOOL

(71) Applicant: TOOLRICH IMP. & EXP. CO., LTD., Hangzhou, Zhejiang (CN)

(72) Inventor: Ruqian Zhang, Zhejiang (CN)

( * ) Notice: Subject to any disclaimer, the term of this patent is extended or adjusted under 35 U.S.C. 154(b) by 317 days.

(21) Appl. No.: 15/065,754

(22) Filed: Mar. 9, 2016

(65) Prior Publication Data

US 2017/0259408 A1 Sep. 14, 2017

(51) Int. Cl.
*B25B 13/46* (2006.01)
*B25B 13/06* (2006.01)

(52) U.S. Cl.
CPC ..... *B25B 13/461* (2013.01); *B25B 13/06* (2013.01)

(58) Field of Classification Search
CPC ... B25B 13/48; B25B 13/481; B25B 23/0028; B25B 13/461; B25G 1/063; B25G 1/066
See application file for complete search history.

(56) References Cited

U.S. PATENT DOCUMENTS 1,453,607 A * 5/1923 Saucier ..... B25B 13/465 81/124.3
1,487,295 A * 3/1924 Trowbridge ..... B25B 23/0014 279/79
7,246,544 B1 * 7/2007 Lee ..... B25B 13/461 81/177.8
7,281,452 B2 * 10/2007 Chang ..... B25B 13/46 81/177.2
7,878,091 B2 * 2/2011 Abel ..... B25B 13/461 81/177.9
7,975,575 B2 * 7/2011 Hu ..... B25B 13/461 81/177.7
8,511,206 B2 * 8/2013 Hong ..... B25G 1/063 81/177.8
9,669,525 B2 * 6/2017 Tsai ..... B25B 23/0028
9,808,917 B1 * 11/2017 Chien ..... B25B 23/0028
2014/0060258 A1 * 3/2014 Anders ..... B25B 13/465 81/60
2016/0288303 A1 * 10/2016 Michas ..... B25B 23/0028

* cited by examiner

*Primary Examiner* — David B Thomas
(74) *Attorney, Agent, or Firm* — Clement Cheng

(57) ABSTRACT

A driver tool has a grip handle. The grip handle has a grip handle height less than a grip handle width. A first axis base is mounted to the grip handle. The first axis base includes a first saddle flange and a second saddle flange. A pair of primary link pins are mounted to the first saddle flange and the second saddle flange defining a first axis of rotation. A coupler link is mounted on the first axis of rotation to rotate on the first axis of rotation relative to the first axis base. A pair of secondary link pins mounted to the coupler link. The pair of secondary link pins define a second axis of rotation that is perpendicular to the first axis of rotation. A driving link is mounted to the second axis of rotation. The driving link includes a driving socket.

12 Claims, 3 Drawing Sheets

DRIVER TOOL

FIELD OF THE INVENTION

The present invention is in the field of driver tools.

DISCUSSION OF RELATED ART

A variety of different driver tools have been invented, such as screw drivers and socket drivers.

SUMMARY OF THE INVENTION

A driver tool has a grip handle. The grip handle has a grip handle height less than a grip handle width. A first axis base is mounted to the grip handle. The first axis base includes a first saddle flange and a second saddle flange. A pair of primary link pins are mounted to the first saddle flange and the second saddle flange defining a first axis of rotation. A coupler link is mounted on the first axis of rotation to rotate on the first axis of rotation relative to the first axis base. A pair of secondary link pins mounted to the coupler link. The pair of secondary link pins define a second axis of rotation that is perpendicular to the first axis of rotation. A driving link is mounted to the second axis of rotation. The driving link includes a driving socket.

The driving link further includes a driving ratchet. The driving socket is mounted on a first side of the driving ratchet so that the driving link has two degrees of freedom. A driving shaft can be mounted on a second side of the driving ratchet opposite the first side of the driving ratchet. The user can select between the driving shaft and the driving link by rotating the driving link 180° relative to the grip handle.

A grip handle opening can be formed between the first saddle flange and the second saddle flange as a concave depression. The coupler link fits within the grip handle opening. The handle disk portion is formed on the grip handle that circumscribes the grip handle opening. The handle disk portion has a handle shoulder that extends to the first axis base.

The coupler link has a total of four openings formed at orthogonally to each other at 90° including a first secondary axis opening formed opposite a second secondary axis opening. The first secondary axis opening and the second secondary axis opening are coaxial to a secondary axis. A coupler left opening and a coupler right opening are formed opposite to each other and coaxial to a primary axis. The first axis base has a base saddle that is downward depression between the first saddle flange and the second saddle flange. The coupler link opening is formed on the coupler link. The coupler link opening receives the driving link. The driving link is pivotally mounted within the coupler link.

A driving shaft is mounted on a second side of the driving ratchet opposite the first side of the driving ratchet. The user can select between the driving shaft and the driving link by rotating the driving link 180° relative to the grip handle. The grip handle opening is formed between the first saddle flange and the second saddle flange. The coupler link fits within the grip handle opening.

A handle disk portion can be formed on the grip handle that circumscribes the grip handle opening. The handle disk portion has a handle shoulder that extends to the first axis base.

The coupler link has a total of four openings formed at orthogonally to each other at 90° including a first secondary axis opening formed opposite a second secondary axis opening. The first secondary axis opening and the second secondary axis opening are coaxial to a secondary axis. A coupler left opening and a coupler right opening are formed opposite to each other and coaxial to a primary axis. The first axis base has a base saddle that is downward depression between the first saddle flange and the second saddle flange.

Figure 1:
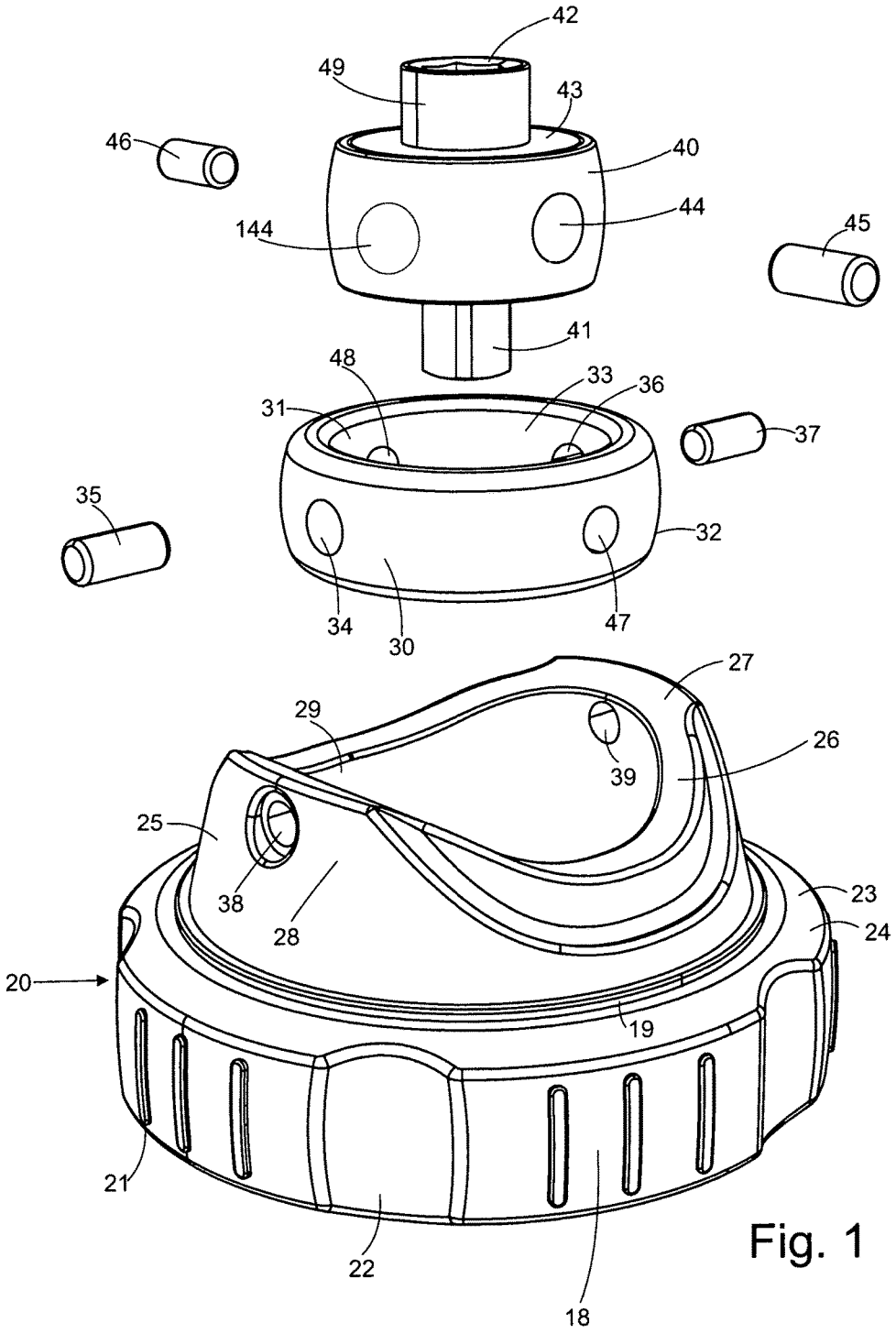
FIG. 1 is an exploded view of the present invention.
Figure 2:
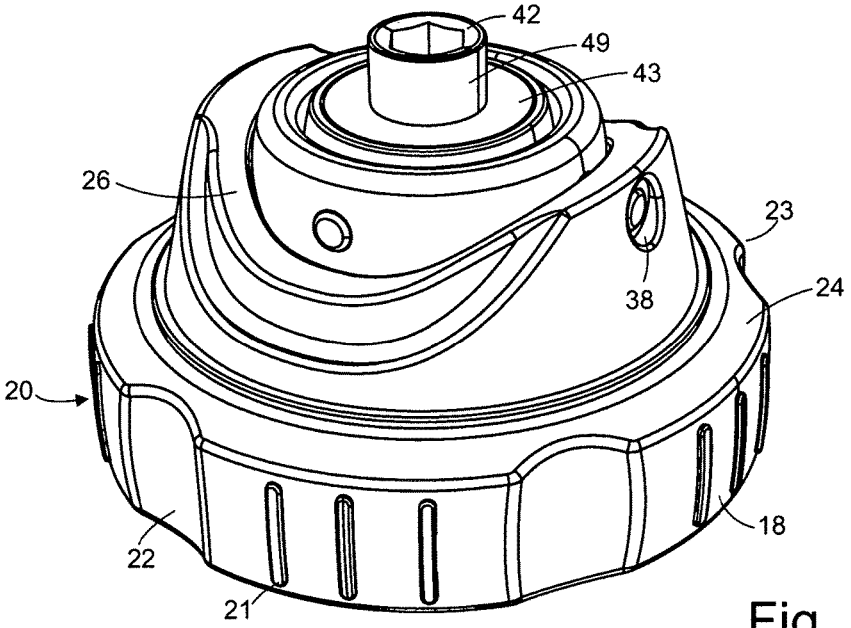
FIG. 2 is a perspective view of the present invention in socket driver mode.
Figure 3:
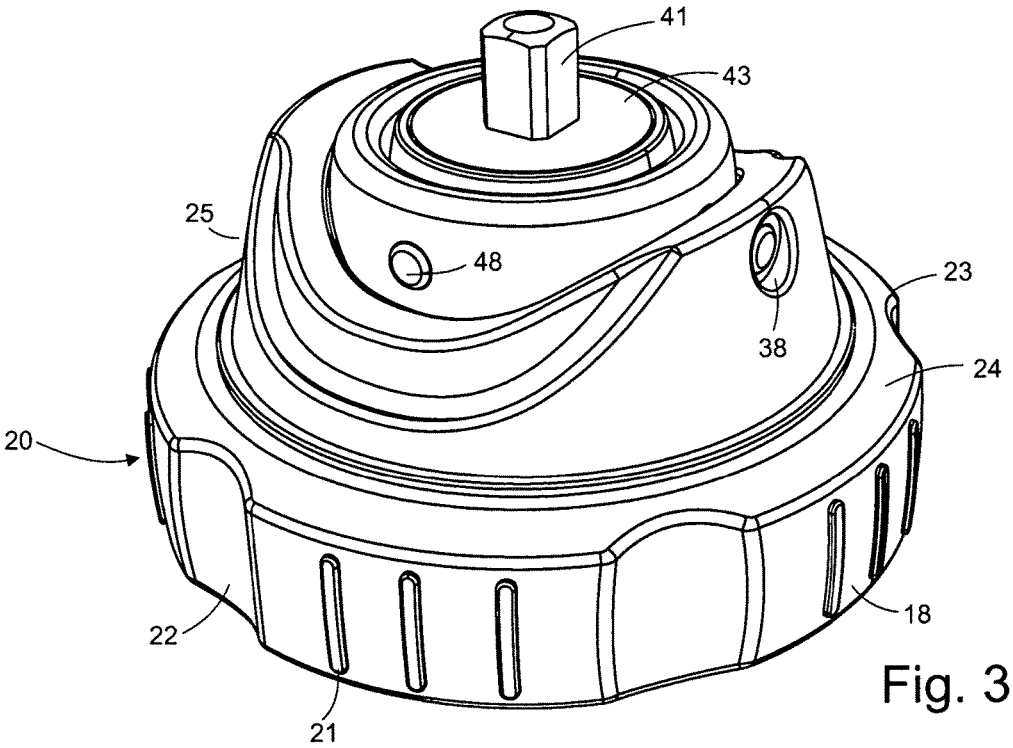
FIG. 3 is a perspective view of the present invention in driver shaft mode.
Figure 4:
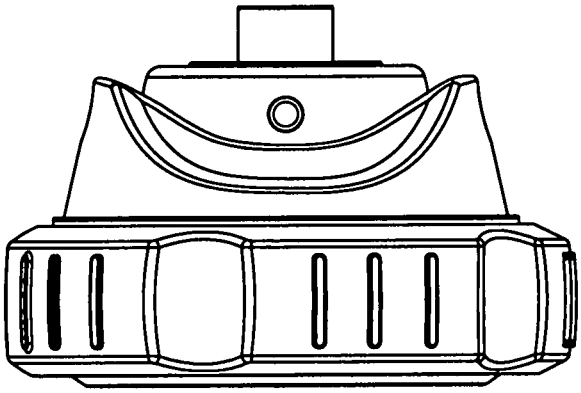
FIG. 4 is a side view of the present invention in socket driver mode.
Figure 5:
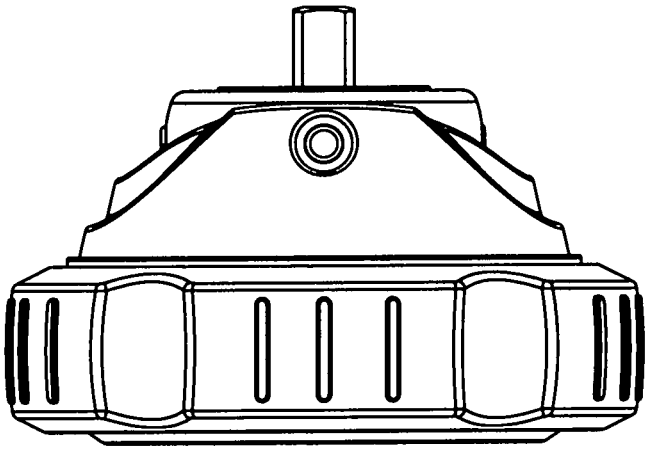
FIG. 5 is a side view of the present invention in driver shaft mode.

The following call out list of elements can be a useful guide in referencing the element numbers of the drawings.

18 Bearing Mode Selector
19 Grip Handle One-Way Bearing
20 Grip Handle
21 Handle Protrusion
22 Handle Indent
23 Handle Disk Portion
24 Handle Shoulder
25 First Axis Base
26 Base Saddle
27 Second Saddle Flange
28 First Saddle Flange
29 Grip Handle Opening
30 Coupler Link
31 Coupler Link Opening
32 Coupler Link Outside Surface
33 Coupler Link Inside Surface
34 Coupler Left Opening
35 First Primary Link Pin
36 Coupler Right Opening
37 Second Primary Link Pin
40 Driving Link
41 Driving Shaft
42 Driving Socket
43 Driving Ratchet
44 Driving Link Axle Opening
45 First Driving Link Axle Pin
46 Second Driving Link Axle Pin
47 First Secondary Axis Opening
48 Second Secondary Axis Opening

DETAILED DESCRIPTION OF THE PREFERRED EMBODIMENT

A driver tool has a grip handle 20 optionally rotationally mounted to a first axis base 25. The grip handle 20 can optionally ratchet relative to the first axis base 25. A mode bearing selector 18 can be mounted as a switch within the grip handle 20. The grip handle 20 can have a grippy surface that includes a handle protrusion 21 and a handle indent 22. The handle protrusions 21 can be vertically oriented and parallel to each other. The handle indent 22 can be formed between sets of three vertically oriented handle protrusions 21. The grip handle 20 is generally formed as a puck shaped disk having a handle disk portion 23 that connects to the first axis base 25 at a handle shoulder 24. The handle shoulder 24 forms a shelf from which the first axis base 25 extends. The handle shoulder 24 and the grip handle 20 have a larger diameter than the first axis base 25. The junction between the first axis base 25 and the handle disk portion 23 can be at a grip handle one-way bearing 19. The grip handle one-way bearing 19 can ratchet in one direction only depending upon a mode selection made at the bearing mode selector 18. The bearing mode selector 18 can be formed as a toggle switch mounted under the handle shoulder 24.

The driver tool has a first axis base 25 that includes a base saddle 26 formed as a valley shaped depression between a first saddle flange 28 and a second saddle flange 27. The first saddle flange 28 has a first flange opening 38 formed orthogonal to an outside surface of the first saddle flange 28. Similarly, the second saddle flange 27 has a second flange opening 39 formed orthogonal to an outside surface of the second saddle flange 27. The first saddle flange 28 extends upwardly from the grip handle 20, and the second saddle flange 27 extends upwardly from the grip handle 20. The first saddle flange and the second saddle flange can be connected together at the base saddle 26. The first flange opening 38 and the second flange opening 39 are both located above the lowest point of the base saddle 26.

The coupler link opening 31 is generally circular passing through a generally circular coupler link 30. The coupler link 30 is pivotally mounted to the first axis base 25 at a first axis also called a primary axis. The first primary link pin 35 and the second primary link pin 37 are both coaxial to the first axis of rotation. The coupler link 30 rotates on the first axis of rotation so that it pivots relative to the first axis base 25. The grip handle opening 29 accepts the coupler link 30 and allows sufficient clearance for the coupler link 30. The grip handle opening 29 is cylindrically shaped to receive the similarly cylindrically shaped coupler link outside surface 32. The first primary link pin 35 is mounted between the coupler left opening 34 and the first flange opening 38. The second primary link pin 37 is preferably coaxial to the first primary link pin 35. The second primary link pin 37 is mounted between the second flange opening 39 and the coupler right opening 36. The first primary link pin 35 and the second primary link pin 37 provide a first axis of rotation that is preferably free and unbiased.

The coupler left opening 34 preferably extends from the coupler link outside surface 32 through the coupler link 30 and to the coupler link opening 31. The coupler right opening 36 preferably extends from the coupler link outside surface 32 through the link 30 and to the coupler link opening 31. The coupler link as a coupler link outside surface 32 that is preferably rounded from a top edge to a bottom edge. The coupler link 30 has a coupler link outside surface 32 that is preferably an annular spherical section. The coupler link 30 preferably also has an inside surface on the coupler link opening 31 that is also preferably an annular spherical section. The driving link 40 also has an outside surface that is rounded for clearing the coupler link opening 31 when the driving link 40 swivels.

A secondary axis can be defined at a normal angle, namely a 90° angle relative to the primary axis. The secondary axis is coaxial with a pair of secondary axis openings, namely a first secondary axis opening 47 and a second secondary axis opening 48. A first secondary axis opening 47 is located between the coupler left opening 34 and the coupler right opening 36. A second secondary axis opening 48 is located between the coupler left opening 34 and the coupler right opening 36 at a location opposite the first secondary axis opening 47. Thus, in the same way that the coupler link 30 is cradled inside the first axis base 25, the driving link 40 is cradled inside the coupler link opening 31 of the coupler link 30. The coupler link 30 and the grip handle 20 are both generally flat members having a height less than a width.

The driving link 40 is pivotally mounted to the coupler link 30 at the secondary axis, and both are pivotally mounted to the first axis base 25 at the primary axis. The driving link 40 is pivotally mounted to the coupler link 30 by a first and second secondary pivot joint. The first secondary axis opening 47 receives a first driving axle pin 45 that pivotally connects the first secondary axis opening 47 to the first driving link axle opening 44. The first axle driving pin 45 and the other axle pins can be formed as bearings such as needle bearings or can be solid metal cylinders having beveled finished tips. The second driving axle pin 46 similarly inserts between the secondary axis opening 48 and the second driving link axle opening 144. The second driving link axle opening 144 is formed on an opposite side of the driving link 40 as the first driving link axle opening 44.

The driving link 40 optionally includes a driving shaft 41 located opposite a driving socket 42 such as a quarter inch ratchet bit driver. The driving shaft 41 and the driving socket 42 are mounted optionally to a driving ratchet 43 which can provide a one-way ratchet motion. The driving socket is preferably formed on a driving socket extension 49 that protrudes above the driving link 40 when the driving socket 42 is in an engaged position. The user can alternate between the driving socket 42 and the driving shaft 41 by flipping the orientation of the driving link 40. The driving link 40 is reversible between a pair of sides, namely a driving shaft side and a driving socket side. The driving shaft 41 extends from the driving link 40 at an angle perpendicular, normal or orthogonal to the first axis of rotation and the second axis of rotation. Similarly, the driving socket 42 extends from the driving link 40 at an angle perpendicular, normal or orthogonal to the first axis of rotation and the second axis of rotation. The extension of the driving shaft 41 or the driving socket 42 is at a level that is accommodated by an indent in the first axis base 25 called the base saddle 26. The base saddle portion provides a clearance for the extension of the driving socket 42 or the driving shaft 41 when the mode selection by flipping is engaged along the primary axis of rotation.

The driving socket 42 can be a hexagonal socket for receiving tool bits such as screwdrivers and augers. The driving socket 42 can receive a drill bit mounted on a hexagonal connector for example. The driving socket extension 49 is cylindrical and can have a ball bearing snap joint secured by a ring-shaped leaf spring that secures the ball bearing to the driving socket extension 49 like a circlip.

The driving shaft 41 can connect to a socket wrench such as a metric or English socket wrench set. The driving shaft 41 can be formed as a square cross-section shaft having beveled corners. The tip of the driving shaft 41 is preferably rounded to clear the inside edge of the base saddle 26.

After the link pins are installed in the openings, the link pins are preferably generally flush or indented to an external surface of the coupler link and to an internal surface of the coupler link. Specifically, the second primary link pin 37 has an inside circular surface that is generally flush or indented to the coupler link opening 31 of the coupler link 30 after the second primary link pin 37 is installed to the coupler right opening 36. Also, the first primary link pin 35 has an inside circular surface that is generally flush or indented to the coupler link opening 31 of the coupler link 30 after the first primary link pin 35 is installed to the coupler left opening 34. Analogously, the first driving link axle pin 45 has an external circular surface that is generally flush or indented to the coupler link outside surface 32 after the first driving link axle pin 45 is installed to the first secondary axis opening 47. Also, the second driving link axle pin 46 has an external surface that is generally flush or indented to the coupler link outside surface 32 after the second driving link axle pin 46 is installed to the coupler link opening 31. Generally flush means that the pin does not protrude enough to abut another member to prevent the intended operation of the device. Either the base saddle 26 or the coupler link 30 may contact the external surface of the pin if the pin protrudes beyond a generally flush level. Thus, the cylindrical openings can have stops formed as restricted portions of diminished diameter that provide a measured stopping distance for insertion of the appropriate pin.

Figure 6:
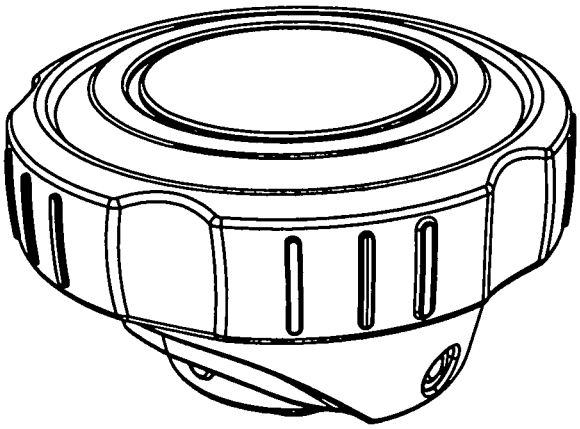
FIG. 6 is a bottom perspective view of the present invention.

Preferably, either the driving ratchet 43 or the grip handle one way bearing 19 provides a one-way ratcheting feature. Both would not be used or implemented simultaneously. Optionally, the mode bearing selector 18 of the grip handle one way bearing 19 can be formed on a bottom button of the grip handle 20 as seen in FIG. 6. To reduce the weight of the low-profile driver, the grip handle 20 is preferably made from plastic. The driving socket, driving link, driving shaft, swivel pins and coupler link are preferably made of metal for improved durability. The grip handle 20 including the first axis base 25 and the base saddle 26 therefore is preferably made from a different material than the coupler link 30 and the driving link 40.

The invention claimed is:

1. A driver tool comprising:

a. a grip handle, wherein the grip handle has a grip handle height less than a grip handle width;

b. a first axis base mounted to the grip handle, wherein the first axis base includes a first saddle flange and a second saddle flange;

c. a pair of primary link pins mounted to the first saddle flange and the second saddle flange defining a first axis of rotation;

d. a coupler link mounted on the first axis of rotation to rotate on the first axis of rotation relative to the first axis base;

e. a pair of secondary link pins mounted to the coupler link, wherein the pair of secondary link pins define a second axis of rotation that is perpendicular to the first axis of rotation; and f. a driving link mounted to the second axis of rotation, wherein the driving link includes a driving socket, wherein the driving link further includes a driving ratchet, wherein the driving socket is mounted on a first side of the driving ratchet, whereby the driving link has two degrees of freedom.

2. The driver tool of claim 1, further including: a driving shaft mounted on a second side of the driving ratchet opposite the first side of the driving ratchet, wherein the user can select between the driving shaft and the driving link by rotating the driving link 180° relative to the grip handle.

3. The driver tool of claim 1, further including: a grip handle opening formed between the first saddle flange and the second saddle flange, wherein the coupler link fits within the grip handle opening.

4. The driver tool of claim 3, further including a handle disk portion formed on the grip handle that circumscribes the grip handle opening, wherein the handle disk portion has a handle shoulder that extends to the first axis base.

5. The driver tool of claim 1, wherein the coupler link has a total of four openings formed at orthogonally to each other at 90° including a first secondary axis opening formed opposite a second secondary axis opening, wherein the first secondary axis opening and the second secondary axis opening are coaxial to a secondary axis, and further including a coupler left opening and a coupler right opening formed opposite to each other and coaxial to a primary axis.

6. The driver tool of claim 1, wherein the first axis base has a base saddle that is downward depression between the first saddle flange and the second saddle flange.

7. The driver tool of claim 1, wherein the coupler link opening is formed on the coupler link, wherein the coupler link opening receives the driving link, wherein the driving link is pivotally mounted within the coupler link.

8. The driver tool of claim 7, further including: a driving shaft mounted on a second side of the driving ratchet opposite the first side of the driving ratchet, wherein the user can select between the driving shaft and the driving link by rotating the driving link 180° relative to the grip handle.

9. The driver tool of claim 7, further including: a grip handle opening formed between the first saddle flange and the second saddle flange, wherein the coupler link fits within the grip handle opening.

10. The driver tool of claim 9, further including a handle disk portion formed on the grip handle that circumscribes the grip handle opening, wherein the handle disk portion has a handle shoulder that extends to the first axis base.

11. The driver tool of claim 7, wherein the coupler link has a total of four openings formed at orthogonally to each other at 90° including a first secondary axis opening formed opposite a second secondary axis opening, wherein the first secondary axis opening and the second secondary axis opening are coaxial to a secondary axis, and further including a coupler left opening and a coupler right opening formed opposite to each other and coaxial to a primary axis.

12. The driver tool of claim 7, wherein the first axis base has a base saddle that is downward depression between the first saddle flange and the second saddle flange.

* * * * *